US011187418B1

(12) United States Patent
DeLoach et al.

(10) Patent No.: US 11,187,418 B1
(45) Date of Patent: Nov. 30, 2021

(54) HVAC SYSTEM WITH MODULAR ARCHITECTURE

(71) Applicant: Katerra Inc., Menlo Park, CA (US)

(72) Inventors: Richard Zane DeLoach, Wentzville, MO (US); David Hull, Seattle, WA (US); Taylor Michael Keep, Berkeley, CA (US)

(73) Assignee: Katerra Inc., Menlo Park, CA (US)

( * ) Notice: Subject to any disclaimer, the term of this patent is extended or adjusted under 35 U.S.C. 154(b) by 106 days.

(21) Appl. No.: 16/734,020

(22) Filed: Jan. 3, 2020

Related U.S. Application Data

(60) Provisional application No. 62/788,314, filed on Jan. 4, 2019, provisional application No. 62/788,334, filed
(Continued)

(51) Int. Cl.
*F24F 1/022* (2019.01)
*F24F 1/0314* (2019.01)
*F24F 1/029* (2019.01)

(52) U.S. Cl.
CPC ..... *F24F 1/022* (2013.01); *F24F 1/029* (2019.02); *F24F 1/0314* (2019.02)

(58) Field of Classification Search
CPC .. F24F 1/022; F24F 1/027; F24F 1/031; F24F 1/0314; F24F 13/0272; F24F 2221/36; F24F 2221/17
See application file for complete search history.

(56) References Cited

U.S. PATENT DOCUMENTS 3,012,762 A * 12/1961 Norris ..... F24F 1/00 165/48.1
5,255,532 A * 10/1993 Chae ..... F24F 13/20 62/325

(Continued)

FOREIGN PATENT DOCUMENTS

CN 104465638 3/2015

OTHER PUBLICATIONS

Non-Final Office Action dated Feb. 25, 2020, U.S. Appl. No. 16/250,727, filed Jan. 17, 2019, applicant: Juntao Zhang, 21 pages.

(Continued)

*Primary Examiner* — Joseph F Trpisovsky
(74) *Attorney, Agent, or Firm* — Haverstock & Owens

(57) ABSTRACT

HVAC system includes a front side access panel, an HVAC unit, a mounting sleeve, and a back side grille. The mounting sleeve and the HVAC unit are configured to fit within the preexisting framing of a building, and in particular to be mounted in a wall, between pre-existing studs, of a room. The HVAC unit can be installed into the mounting sleeve via quick connect mechanisms including, but not limited to, snap in connections and/or tab and slot features. The mounting sleeve enables rapid installation and also condensate collection. The HVAC unit includes separate modular units, e.g. an evaporator module unit, a mechanical module unit, and a condenser module unit, that are mounted and interconnected to each other. The HVAC system includes vertically oriented HVAC components and component connections that are self-aligned, and can be further configured with a horizontal configuration portion for multi-zone capability.

18 Claims, 10 Drawing Sheets

Related U.S. Application Data on Jan. 4, 2019, provisional application No. 62/788,342, filed on Jan. 4, 2019, provisional application No. 62/788,350, filed on Jan. 4, 2019.

(56) References Cited

U.S. PATENT DOCUMENTS

| | | | | |
|---|---|---|---|---|
| 6,371,637 | B1 | 4/2002 | Atchinson | |
| 6,701,741 | B2 * | 3/2004 | Liu | F24F 1/027 62/429 |
| 7,258,606 | B1 * | 8/2007 | Reid | F24F 1/027 312/101 |
| 2004/0007981 | A1 | 1/2004 | Shibata | |
| 2010/0141153 | A1 | 6/2010 | Recker | |
| 2011/0227489 | A1 | 9/2011 | Huynh | |
| 2012/0162965 | A1 | 6/2012 | Takeuchi | |
| 2012/0299489 | A1 | 11/2012 | Sakuragi | |
| 2014/0175996 | A1 | 6/2014 | Yoon | |
| 2015/0043212 | A1 | 2/2015 | Coffey | |
| 2016/0034137 | A1 | 11/2016 | Dekker | |
| 2017/0138542 | A1 | 5/2017 | Gielen | |
| 2017/0138617 | A1 * | 5/2017 | Kim | F24F 13/20 |
| 2018/0363893 | A1 | 12/2018 | Cheng | |
| 2019/0120438 | A1 | 4/2019 | Wan | |
| 2019/0166661 | A1 | 5/2019 | Gao | |

OTHER PUBLICATIONS

Notice of Allowance dated Jun. 11, 2019, U.S. Appl. No. 16/197,003, filed Jan. 20, 2018, Applicant: Shanfu Gao, 15 pages.

* cited by examiner

HVAC SYSTEM WITH MODULAR ARCHITECTURE

RELATED APPLICATIONS

This patent application claims priority under 35 U.S.C. 119(e) of the U.S. provisional patent application, Application Ser. No. 62/788,314, filed on Jan. 4, 2019, and entitled "HVAC Control System", U.S. provisional patent application, Application Ser. No. 62/788,334, filed on Jan. 4, 2019, and entitled "HVAC System with Modular Architecture", U.S. provisional patent application, Application Ser. No. 62/788,342, filed on Jan. 4, 2019, and entitled "HVAC System with Single Piece Body", U.S. provisional patent application, Application Ser. No. 62/788,350, filed on Jan. 4, 2019, and entitled "HVAC System with Coil Arrangement in Blower Unit", which are each hereby incorporated in their entireties by reference.

FIELD OF THE INVENTION

The present invention is generally directed to a HVAC (Heating, Ventilating, and Air Conditioning) system. More specifically, the present invention is directed to an HVAC system with a modular architecture.

BACKGROUND OF THE INVENTION

An air conditioning system typically includes an evaporator coil, a condenser, an accumulator, a condensor, and a metering device. The components are interconnected by pipes or tubing, and separate fans move air across the evaporator coil and the condenser. A refrigerant is in various phases as it flows through the air conditioning components. Circulating refrigerant vapor enters the compressor and is compressed to a higher pressure, resulting in a higher temperature as well. The compressed refrigerant vapor is now at a temperature and pressure at which it can be condensed and is routed through the condenser. In the condenser, the compressed refrigerant vapor flows through condenser coils. A condenser fan blows air across the condenser coils thereby transferring heat from the compressed refrigerant vapor to the flowing air. Cooling the compressed refrigerant vapor condenses the vapor into a liquid. The condensed refrigerant liquid is output from the condenser to the accumulator where the condensed refrigerant liquid is pressurized. The condensed and pressurized refrigerant liquid is output from the accumulator and routed through the metering device where it undergoes an abrupt reduction in pressure. That pressure reduction results in flash evaporation of a part of the liquid refrigerant, lowering its temperature. The cold refrigerant liquid/vapor is then routed through the evaporator coil. The result is a mixture of liquid and vapor at a lower temperature and pressure. The cold refrigerant liquid-vapor mixture flows through the evaporator coil and is completely vaporized by cooling the surface of the evaporator coil and cooling air moving across the evaporator coil surface. The resulting refrigerant vapor returns to the compressor to complete the cycle.

In a single family unit, certain components of the air conditioning system are located inside the house and other components are located outside, for example the condenser and condenser fan are located outside the house and the remaining components are located inside. Typically, the inside components are co-located with the furnace, related air moving components, and air ducts associated with the house's HVAC system. However, in multi family units, such as apartment or condominium complexes, separate positioning of the air conditioning components both inside and outside of each unit is not always feasible. Integrated, box-like, air conditioning units are often used. Such units can be mounted in windows or custom sized wall openings, with a portion of the unit extending into the living area and another portion extending outside beyond an outer wall of the dwelling.

SUMMARY OF THE INVENTION

Embodiments are directed to an HVAC system that includes a front side access panel, an HVAC unit, a mounting sleeve, and a back side grille. The mounting sleeve and the HVAC unit are configured to fit within the preexisting framing of a building, and in particular to be mounted in a wall, between pre-existing studs, of a room. The HVAC unit can be installed into the mounting sleeve via quick connect mechanisms including, but not limited to, snap in connections and/or tab and slot features. The mounting sleeve enables rapid installation and also condensate collection. The HVAC unit includes separate modular units that are mounted and interconnected to each other. A first modular unit is an evaporator module, a second modular unit is a mechanical module, and a third modular unit is a condenser module. The design of the HVAC system is optimized to maximize space utilization and support efficient installation and servicing while minimizing product intrusion into living space. The HVAC system includes vertically oriented HVAC components and component connections that are self-aligned. In some embodiments, the HVAC system can be further configured with a horizontal configuration portion for multi-zone capability.

In an aspect, a heating, ventilation, and air condition (HVAC) system is disclosed. The HVAC system includes an HVAC unit and a mounting sleeve. The HVAC unit comprises an evaporator modular unit having a first heat exchanger, a mechanical modular unit having an HVAC unit controller, and a condenser modular unit having a second heat exchanger. The evaporator modular unit, the mechanical modular unit, and the condenser modular unit are separate and distinct modules interconnected by refrigerant tubing. The mounting sleeve is configured to fit within a preexisting framework of a dwelling, wherein the evaporator modular unit, the mechanical modular unit, and the condenser modular unit are mounted within the mounting sleeve. In some embodiments, the HVAC system further comprises a front side access panel coupled to a front side of the HVAC unit. In some embodiments, the front side access panel comprises a front side grille aligned with the evaporator modular unit. In some embodiments, the HVAC system further comprises a back side grille coupled to a back side of the HVAC unit. In some embodiments, the mounting sleeve includes a back side opening in a back side wall, the back side opening is aligned with the condenser modular unit of the HVAC unit and an exterior opening of the dwelling, further wherein the back side grille is positioned over back side opening. In some embodiments, the mounting sleeve comprises a back side wall, side walls, a top wall and a bottom wall, wherein the back side wall is mounted to a framing back side wall of the preexisting framework, and each of the side walls is mounted to a stud of the preexisting framework. In some embodiments, one or more of the side walls of the mounting sleeve includes an electrical outlet opening. In some embodiments, the mechanical modular unit further comprises an electrical power cord, a first end of which is configured to fit through the electrical outlet opening. In some embodiments, the mounting sleeve comprises a bottom side wall that is sloped downward from a front side of the HVAC unit to a back side of the HVAC unit. In some embodiments, the bottom side wall comprises one or more drainage openings. In some embodiments, the mounting sleeve further comprises a back side wall having one or more drainage openings proximate the bottom side wall. In some embodiments, the refrigerant tubing comprises first interconnecting refrigerant tubing coupled to the evaporator modular unit and the mechanical modular unit, and second interconnecting refrigerant tubing coupled to the mechanical section and the condenser section. In some embodiments, the HVAC unit further comprises first mounting features and the mounting sleeve further comprises second mounting features for mounting to the first mounting features. In some embodiments, the first heat exchanger of the evaporator modular unit comprises an evaporator coil, and the evaporator modular unit further comprises an air mover configured to move air across the evaporator coil. In some embodiments, the second heat exchanger of the condenser modular unit comprises a condenser coil, and the condenser modular unit further comprises an air mover configured to move air across the condenser coil. In some embodiments, the condenser modular unit further comprises an accumulator coupled to the condenser coil. In some embodiments, the mechanical modular unit further comprises a compressor and a metering device. In some embodiments, the evaporator modular unit comprises an evaporator modular unit housing, the mechanical modular unit comprises an mechanical modular unit housing, and the condenser modular unit comprises a condenser modular unit housing.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the present application are directed to an HVAC system. Those of ordinary skill in the art will realize that the following detailed description of the HVAC system is illustrative only and is not intended to be in any way limiting. Other embodiments of the HVAC system will readily suggest themselves to such skilled persons having the benefit of this disclosure.

Reference will now be made in detail to implementations of the HVAC system as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
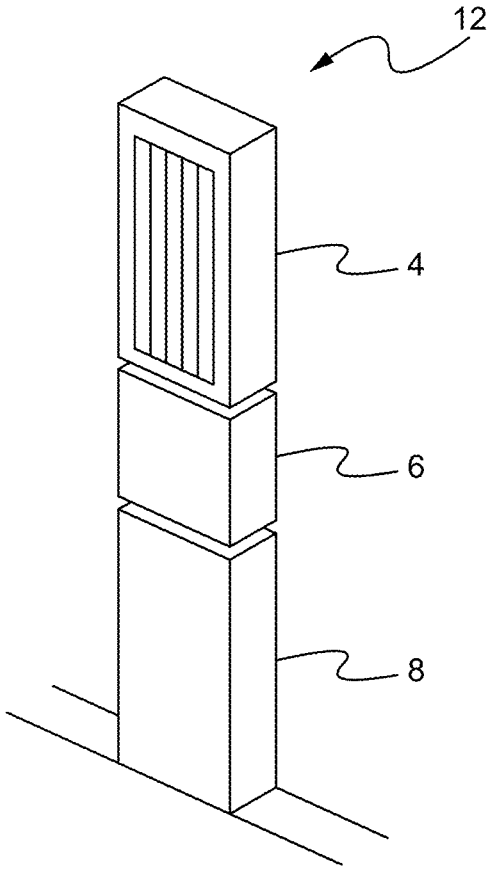
FIG. 1 illustrates a perspective view of the HVAC unit as assembled according to some embodiments.

FIG. 1 illustrates a perspective view of the HVAC unit 12 as assembled according to some embodiments. In some embodiments, the HVAC unit 12 is installed within the preexisting framing of a wall, although as shown in FIG. 1 this framing is removed to better illustrate the HVAC unit as assembled. The HVAC unit 12 includes three separate modular units: an indoor air cycling modular unit 4, a mechanical modular unit 6, and an outdoor air cycling modular unit 8. The indoor air cycling modular unit, or simply "indoor modular unit", cycles air from an interior area of a dwelling (indoors) and back out to the interior area. The outdoor air cycling modular unit, or simply "outdoor modular unit", cycles air from an area exterior to the dwelling (outdoors) and back out to the exterior area. In an application where air conditioning cooling is performed, the indoor modular unit functions as an evaporator modular unit, and the outdoor modular unit functions as a condenser modular unit. Subsequent discussion is directed to air conditioning cooling and therefore reference is made to an evaporator modular unit and a condenser modular unit. It is understood that the HVAC unit also can be used for heating, in which case the functionality of the indoor modular unit and the outdoor modular unit can be reversed from that described regarding an evaporator modular unit and a condenser modular unit. Although subsequent description is directed to an evaporator modular unit and a condenser modular unit, it is understood that such description can be generally applied to an indoor modular unit and an outdoor modular unit that performs a heating function.

The evaporator modular unit 4 includes a heat exchanger, an air mover, and electrical circuitry. In some embodiments, the components of the evaporator modular unit 4 are enclosed within an evaporator modular unit housing. In some embodiments, the heat exchanger includes an evaporator coil and interconnecting refrigerant tubing. The evaporator modular unit housing includes input and output openings for the interconnecting refrigerant tubing in the evaporator module unit 4 to complementary refrigerant tubing external to the evaporator modular unit 4, such as refrigerant tubing within the mechanical modular unit 6. The refrigerant tubing in the evaporator modular unit 4 can be connected to adapters at the input and output openings of the evaporator modular unit housing, such as quick disconnect adapters, for interconnecting to other mated adapters connected to refrigerant tubing external to the evaporator module unit 4. In some embodiments, the air mover includes a motor and a fan. In some embodiments, the electrical circuitry includes power wiring, control wiring, and control/diagnostic sensors.

The mechanical modular unit 6 includes refrigerant loop components, in-line components, and electrical circuitry. In some embodiments, the components of the mechanical modular unit 4 are enclosed within an mechanical modular unit housing. In some embodiments, the refrigerant loop components include a compressor and a metering device, such as an electronic expansion valve. In some embodiments, the in-line components include one or more valves, one or more filters, and interconnecting refrigerant tubing. The mechanical modular unit housing includes first input and output openings for the interconnecting refrigerant tubing in the mechanical module unit 6 to complementary refrigerant tubing external to the mechanical modular unit 6, such as refrigerant tubing within the evaporator modular unit 4. The mechanical modular unit housing also includes second input and output openings for the interconnecting refrigerant tubing in the mechanical module unit 6 to still other complementary refrigerant tubing external to the mechanical modular unit 6, such as refrigerant tubing within the condenser modular unit 8. The refrigerant tubing in the mechanical modular unit 6 can be connected to adapters at the first input and output openings and the second input and output openings of the mechanical modular unit housing, such as quick disconnect adapters, for interconnecting to other mated adapters connected to refrigerant tubing external to the mechanical module unit 6. In some embodiments, the electrical circuitry of the mechanical modular unit includes HVAC unit controls, electrical components, power wiring, control wiring, and control/diagnostics sensors.

The condenser modular unit 8 includes a heat exchanger, an air mover, an auxiliary heating component, air quality components, and electrical circuitry. In some embodiments, the components of the condenser modular unit 8 are enclosed within an condenser modular unit housing. In some embodiments, the heat exchanger of the condenser modular unit includes a condenser coil and interconnecting refrigerant tubing. The condenser modular unit can also include an accumulator. The condenser modular unit housing includes input and output openings for interconnecting refrigerant tubing in the condenser module unit 8 to complementary refrigerant tubing external to the condenser modular unit 8, such as refrigerant tubing within the mechanical modular unit 6. The refrigerant tubing in the condenser modular unit 8 can be connected to adapters at the input and output openings of the condenser modular unit housing, such as quick disconnect adapters, for interconnecting to other mated adapters connected to refrigerant tubing external to the condenser module unit 8. In some embodiments, the air mover in the condenser modular unit includes a motor and a fan. In some embodiments, the auxiliary heating component includes one or more resistive heating elements. In some embodiments, the air quality components include an air filter and ventilation components. In the some embodiments, the electrical circuitry of the condenser modular unit includes power wiring, control wiring, and control/diagnostic sensors.

Figure 2:
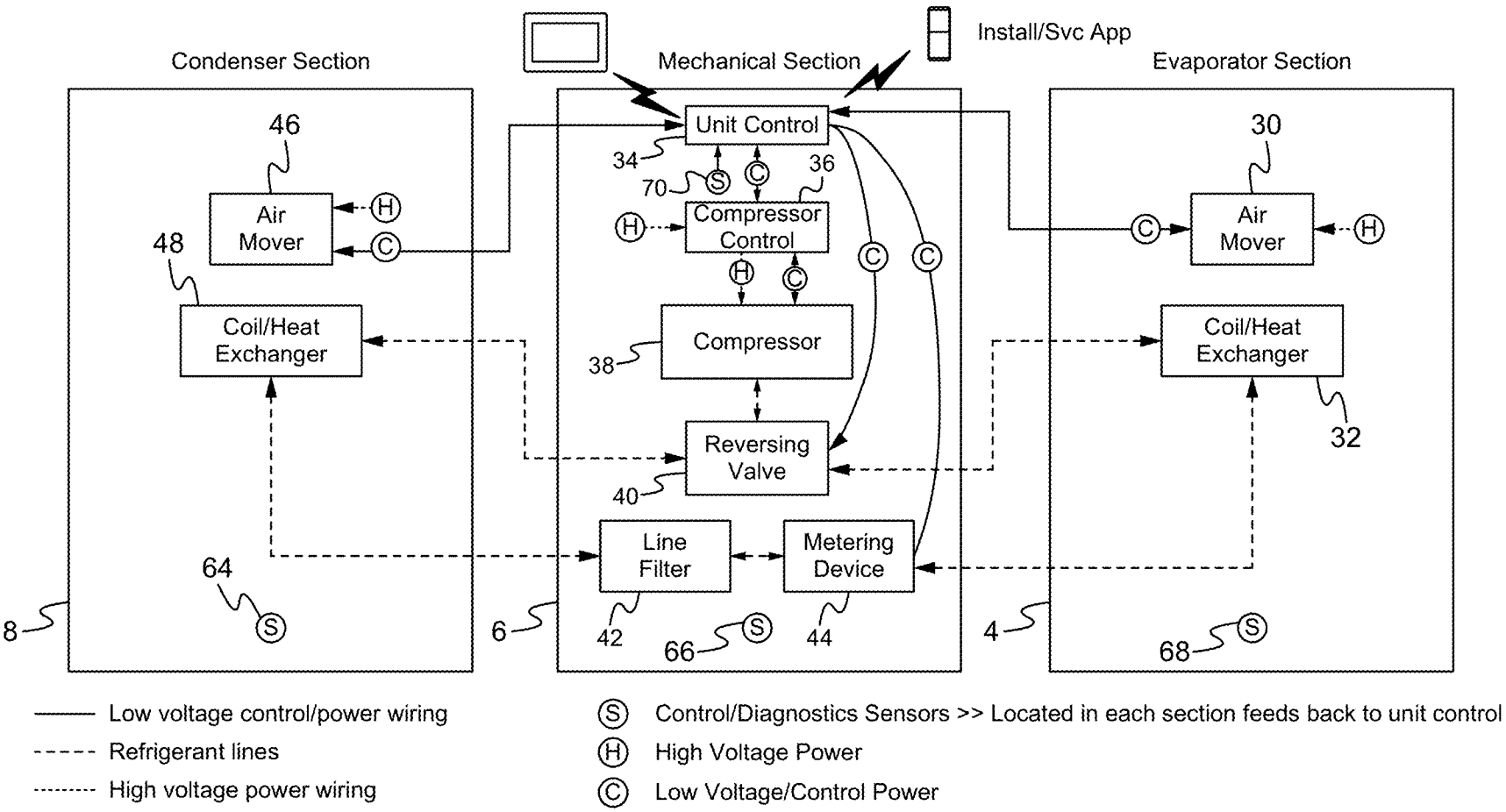
FIG. 2 illustrates a schematic block diagram of the HVAC unit and constituent components corresponding to air conditioning functionality according to some embodiments.

FIG. 2 illustrates a schematic block diagram of the HVAC unit 12 and constituent components corresponding to air conditioning functionality according to some embodiments. A heat exchanger 32 including an evaporator coil in the evaporator modular unit 4 is coupled to a compressor 30 via interconnecting refrigerant tubing and one or more valves 40. The compressor 38 is coupled to a heat exchanger 48 including a condenser coil in the condenser modular unit 8 via interconnecting refrigerant tubing and the one or more valves 40. The heat exchanger 48 can also include an accumulator (not shown) that is coupled to the condenser coil via interconnecting refrigerant tubing. The heat exchanger 48 is coupled to a metering device 44 via interconnecting refrigerant tubing, one or more valves, and filters 42. The metering device 44 is coupled to the heat exchanger 32 via interconnecting refrigerant tubing. In this manner a refrigerant loop is formed, where the refrigerant loop includes the evaporator coil in the heat exchanger 32, the compressor 38, the condenser coil and the accumulator in the heat exchanger 48, the metering device 44, and the interconnecting tubing, valves, and filters. It is understood that the number and configuration of interconnecting refrigerant tubing, valves, and filters shown in FIG. 2 is for exemplary purposes only and that alternative configurations are also contemplated for interconnecting the heat exchanger 32, the compressor 38, the heat exchanger 48, and the metering device 40. It is also understood that the direction of refrigerant flow can be one direction for cooling functionality (air conditioning) and the other direction for heating functionality.

An air mover 30 in the evaporator modular unit 4 is coupled to the heat exchanger 32 to blow air over the evaporator coil, and an air mover 46 in the condenser modular unit 8 is coupled to the heat exchanger 48 to blow air over the condenser coil. A compressor controller 36 is coupled to the compressor 38. An HVAC unit controller 34 is coupled to the air mover 30, the compressor controller 36, the one or more valves such as valves 40, the metering device 44, and the air mover 46. Control signaling, indicated by "C" in FIG. 2, is transmitted between the compressor controller 36 and the compressor 38, and between the HVAC unit controller 34 and the air mover 30, the compressor controller 36, the one or more valves such as valves 40, the metering device 44, and the air mover 46. In some embodiments, the compressor controller 36 can be integrated as part of the HVAC unit controller 34. Control/diagnostic sensors 64, 66, 68, 70 can be used to sense various ambient conditions, such as temperature or humidity, which are connected back to the HVAC unit controller 34 and can be used to control the various components of the HVAC unit 12. High voltage power, such as 120 VAC, is supplied to each of the air mover 30, the compressor controller 36, and the air mover 46. High voltage power can be supplied from the compressor controller 36 to the compressor 38. High voltage power input is indicated by "H" in FIG. 2. Low voltage power is supplied to the unit controller 34. Low voltage power can be provided via wiring labeled "C". It is understood that alternative power supply configurations are also contemplated.

In some embodiments, air filters are included as part of the evaporator modular unit 4 and the condenser modular unit 8. Air is drawn into the evaporator modular unit 4, such as from the room in which the HVAC is installed, directed across the evaporator coil, and output from the evaporator modular unit 4 back into the room. The air filter can be positioned at an air intake portion of the evaporator modular unit 4 such that air is filtered prior to being blown across the evaporator coil. Similarly, air is drawn into the condenser modular unit 8, such as from outside the dwelling within which the HVAC is installed, directed across the condenser coil, and output from the condenser section 8 back outside the dwelling. The air filter can be positioned at an air intake portion of the condenser modular unit 8 such that air is filtered prior to being blown across the condenser coil.

Figure 3:
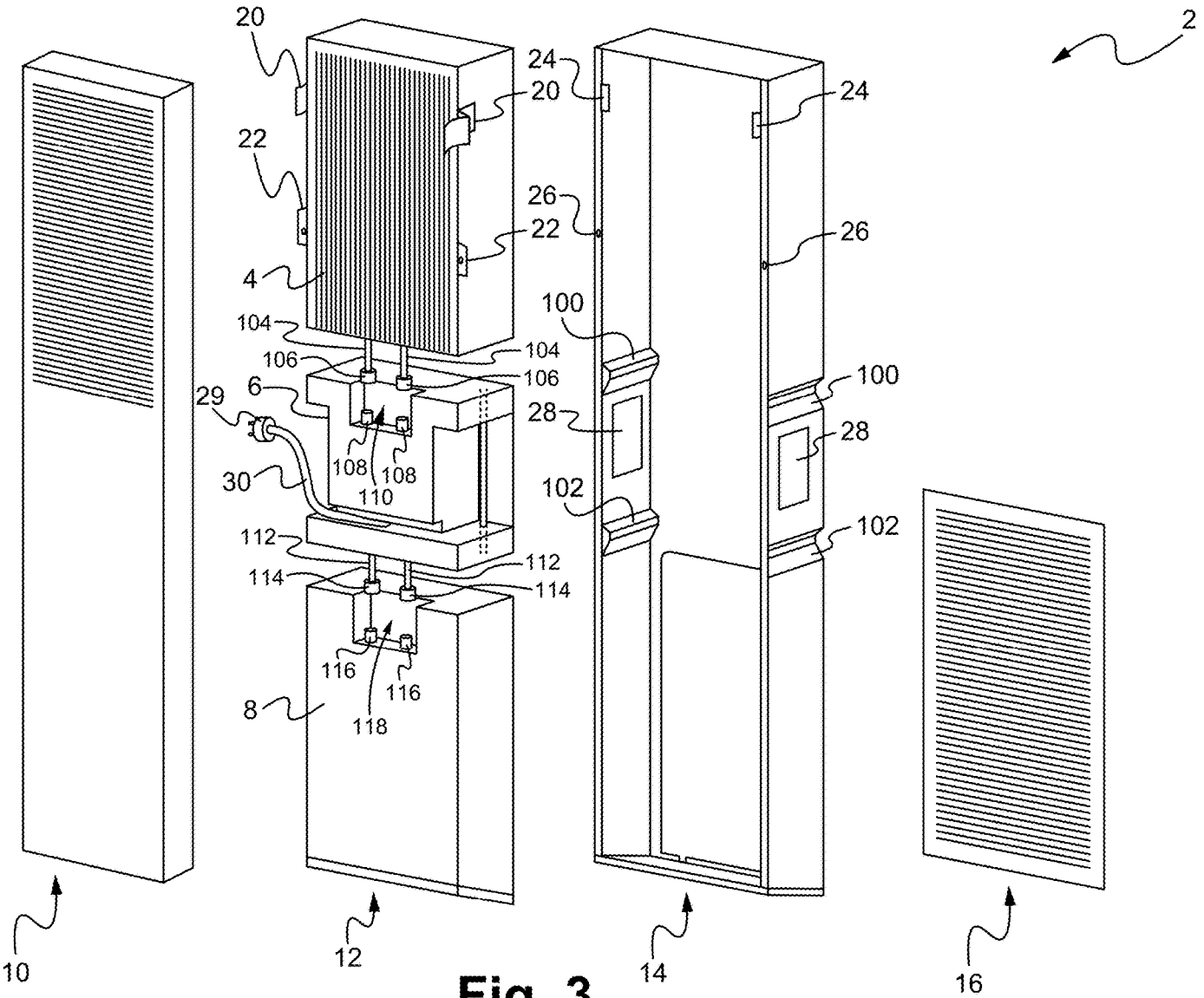
FIG. 3 illustrates an exploded view of an HVAC system having a modular HVAC unit according to some embodiments.
Figure 4:
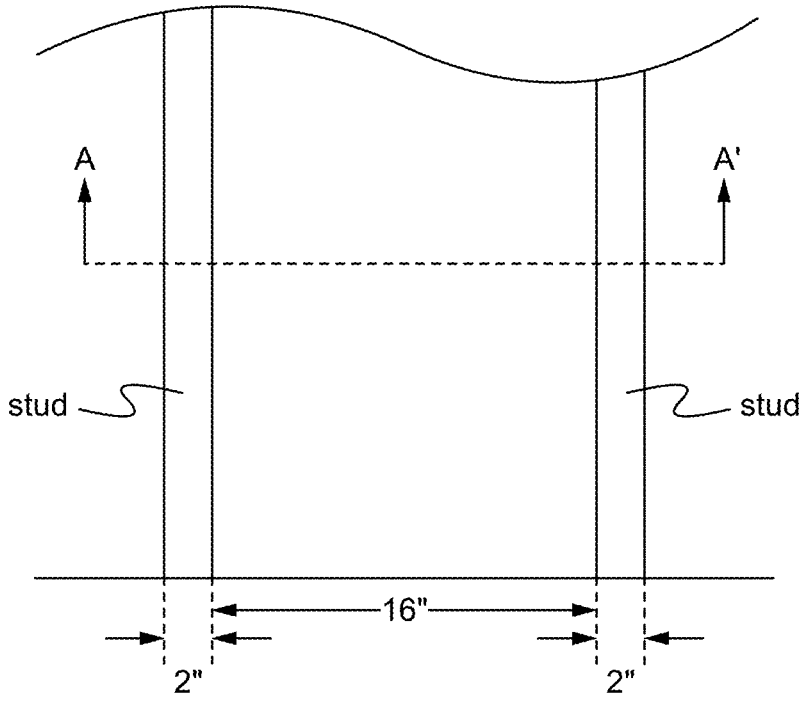
FIG. 4 illustrates an exemplary preexisting framework into which the HVAC system can be installed according to some embodiments.
Figure 5:
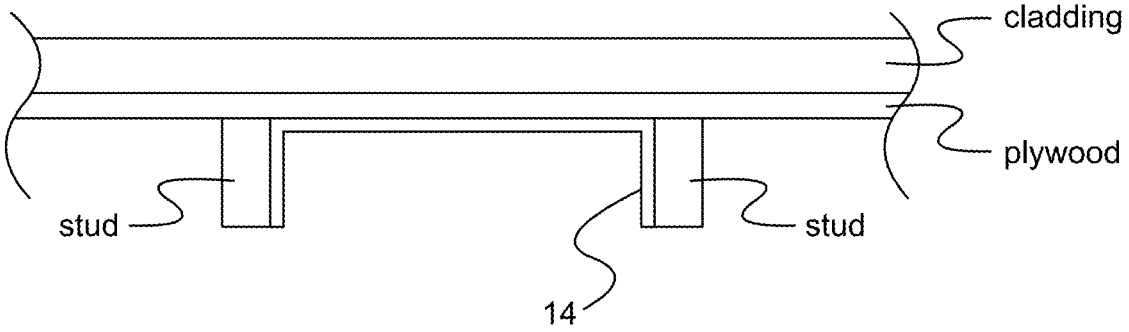
FIG. 5 illustrates a top down view of the mounting sleeve mounted in a preexisting framework of a wall according to some embodiments.

In some embodiments, the HVAC unit is an assembly of distinct modular units that include the evaporator modular unit, the mechanical modular unit, and the condenser modular unit. The modular HVAC unit is mounted within a mounting sleeve, and an indoor grille and an outdoor grille are attached to cover exposed portions of the HVAC unit. FIG. 3 illustrates an exploded view of an HVAC system having a modular HVAC unit according to some embodiments. The HVAC system includes a front side access panel 10, a modular HVAC unit 12, a mounting sleeve 14, and a back side grille 16. The mounting sleeve 14 is configured to be mounted between preexisting framework of a dwelling, such as a room of an apartment or condominium. In an exemplary application, the mounting sleeve fits between two adjoining studs in a wall. FIG. 4 illustrates an exemplary preexisting framework into which the HVAC system can be installed according to some embodiments. The preexisting framework can be an exposed portion of a wall. As shown in FIG. 4, the exposed portion of the wall has the drywall removed from an interior side of the room, thereby exposing adjacent studs and the area in between. The area between the adjacent studs is void of insulating material, electrical wiring, plumbing, and the like so as to enable positioning and mounting of the mounting sleeve 14 within this area. The mounting sleeve 14 is sized to fit conventional framing configurations. For example, a conventional opening between adjacent studs is 16". FIG. 5 illustrates a top down view of the mounting sleeve mounted in a preexisting framework of a wall according to some embodiments. The top down view shown in FIG. 5 corresponds to the cross-section A-A' shown in FIG. 4. A back side of the area between the studs may include plywood, cladding, and/or other materials known in the art. In an exemplary configuration, a back side surface that is exposed within the area between adjacent studs is made of plywood. The mounting sleeve 14 is configured to fit within the area between adjacent studs and against the back side surface. In some embodiments, the mounting sleeve 14 is secured to the adjacent studs using screws. The mounting sleeve 14 can include holes to receive the screws, or the screws can be screwed in directly through the mounting sleeve material, forming holes as the screws are applied. In some embodiments, the mounting sleeve 14 is also secured to the back side surface of the preexisting framework in a manner similar to that of the studs. It is understood that alternative techniques can be used to secure the mounting sleeve to the preexisting framework.

In some embodiments, one or both of the adjacent studs are configured with a power outlet, such as an AC voltage wall socket, or include a hole through which electrical wiring can be strung to access a power outlet. The mounting sleeve 14 can be configured with one or more side openings, such as side openings 28 shown in FIG. 3, coincident with the power outlets on one or both of the adjacent studs. The side openings 28 enable the HVAC unit 12 to access the power outlet(s) and connect to power. In some embodiments, the HVAC 12 includes a power cord and plug 30 configured for connecting to a conventional power outlet, such as the AC voltage wall socket, which provides the high voltage power "H".

The HVAC unit 12 and the mounting sleeve 14 can each include complementary mounting apparatuses for mounting the HVAC unit 12 to the mounting sleeve 14. In the exemplary configuration shown in FIG. 3, the mounting sleeve 14 includes mounting protrusions 100 and mounting protrusions 102 extending from both side walls. The evaporator module unit 4 is configured to slide into the mounting sleeve 14 and rest on the mounting protrusions 100, and the mechanical module unit 6 is configured to slide into the mounting sleeve 14 and rest on the mounting protrusions 102. In some embodiments, a bottom surface of the evaporator module unit housing contacts a top surface of the mechanical module unit housing, providing an added degree of support. In some embodiments, an elastomer or some other type of padding is positioned between the bottom surface of the evaporator module unit housing and the top surface of the mechanical module unit housing and can function, in part, to reduce vibrations. Similarly, in some embodiments, a bottom surface of the mechanical module unit housing contacts a top surface of the condenser module unit housing. In some embodiments, an elastomer or some other type of padding is positioned between the bottom surface of the mechanical module unit housing and the top surface of the condenser module unit housing.

Also in the exemplary configuration shown in FIG. 3, the mounting sleeve 14 includes holes 26 in the side walls and also includes flanges 24 that extend from the side walls. The HVAC unit 12 includes mounting tabs 20 configured to mate to the flanges 24 in the mounting sleeve 14. The HVAC unit 12 also includes flanges 22 with holes where screws or fasteners, such as quarter turn fasteners, can be inserted into the holes 26 of the mounting sleeve 14. The holes 26 can be screw holes for accepting screws or fasteners. It is understood that additional mounting tab/flange and/or flange/screw hole combinations can be used, or only mounting tab/flange or only flange/screw hole implementations can be used. It is further understood that alternative complementary mounting apparatuses can be used to mount the HVAC unit 12 to the mounting sleeve 14. Also mounting structure are only shown for the evaporator module unit 4, it is understood that the mechanical module unit 6 and/or the condenser module unit 8, can include similar mounting structures, and the mounting sleeve 14 can include complementary mounting structures.

Refrigerant tubing in the evaporator module unit 4 is connected to refrigerant tubing in the mechanical module section 6 via refrigerant tubing 104 with adapters 106 configured to mate with complementary adapters (not shown) in the evaporator modular unit housing and adapters 108 in the mechanical modular unit housing. In some embodiments, the adapters 108 are positioned in a recessed area 110 the mechanical modular unit housing, which provides improved access for easier connection and disconnection of the adapters 108 and refrigerant tubing 104. Other refrigerant tubing in the mechanical module unit 6 is connected to refrigerant tubing in the condenser module section 8 via refrigerant tubing 112 with adapters 114 configured to mate with complementary adapters (not shown) in the mechanical modular unit housing and adapters 116 in the evaporator modular unit housing. In some embodiments, the adapters 116 are positioned in a recessed area 118 the evaporator modular unit housing, which provides improved access for easier connection and disconnection of the adapters 116 and refrigerant tubing 112.

Once the evaporator modular unit 4, the mechanical modular unit 6, and the condenser modular unit 8 are mounted in the mounting sleeve 14 and the appropriate refrigerant tubes are connected, the front side access panel 10 is attached. The back side grille 16 is attached on an exterior surface of the dwelling and can be attached either before or after the HVAC unit 12 is mounting in the mounting sleeve 14.

Figure 6:
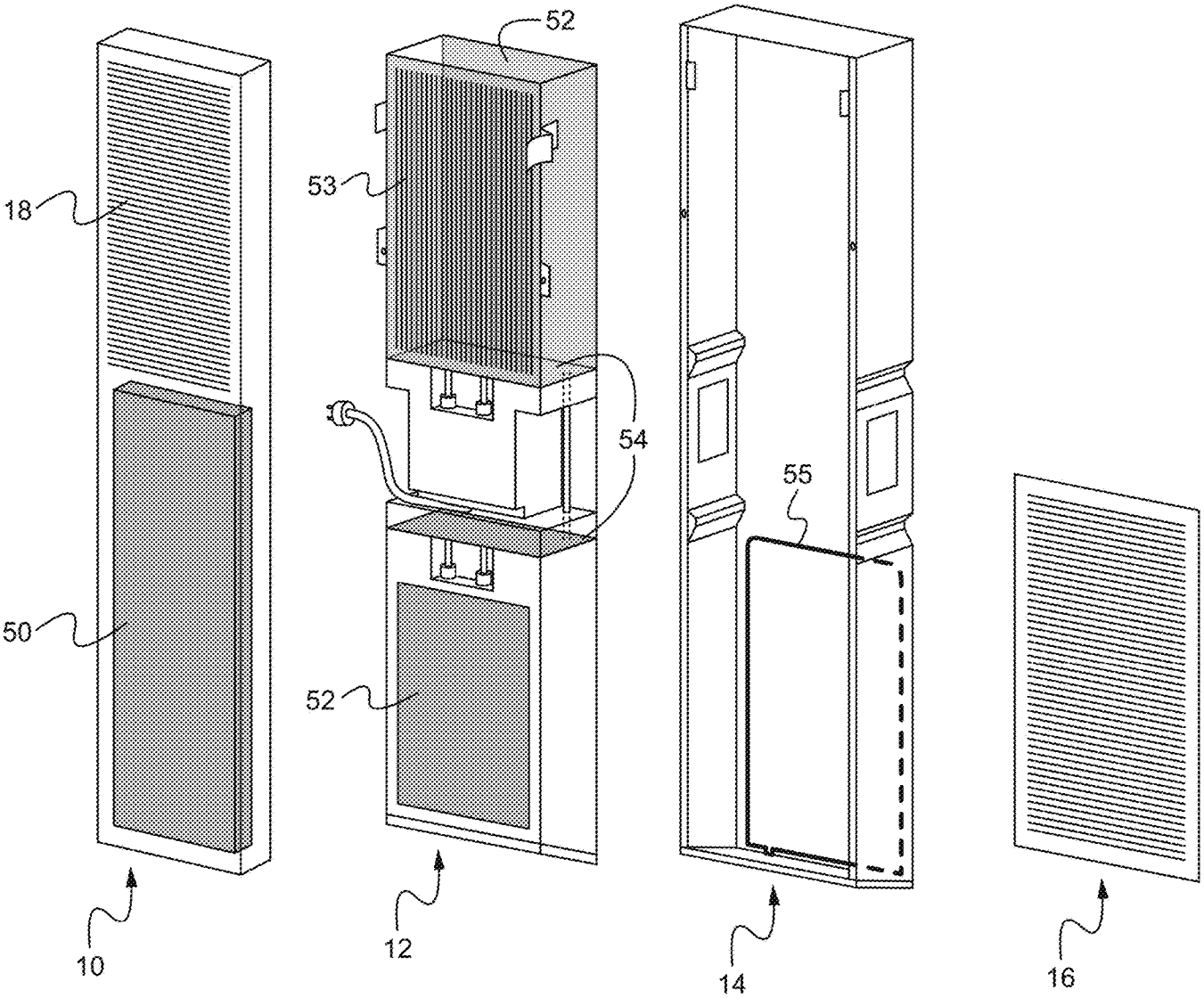
FIG. 6 illustrates an exploded view of the HVAC system including exemplary materials for providing thermal, sound, and water isolation according to some embodiments.

Various materials can be added to provide thermal, sound, and water isolation. In particular, thermal and sound resistant materials can be included to provide thermal and sound isolation of the HVAC unit from the interior dwelling. Water resistant materials can be used to manage condensate formed in the evaporator section. FIG. 6 illustrates an exploded view of the HVAC system including exemplary materials for providing thermal, sound, and water isolation according to some embodiments. A sound isolation panel 50 can be positioned on an interior surface of the front side access panel 10 without blocking the grille 18. Similar material can be positioned around or proximate the air mover 30 in the evaporate modular unit 4 and the air mover 46 in the condenser modular unit 8 to provide vibrational isolation. Thermal isolation panels 52 can be positioned on the back side facing surface of the evaporator modular unit 4 and the front side facing surface of the condenser modular unit 8. A thermal isolation trim 53 can be positioned around a front side facing perimeter of the evaporator modular unit 4 without blocking the grille 18.

Condensate forms in the evaporator modular unit 4 and may form on the outer surfaces of the evaporator modular unit 4 and portions of the mounting sleeve 14 in contact with the evaporator modular unit 4. Moisture barriers are positioned to prevent condensate from entering the mechanical modular unit 6. A moisture barrier 54 can be positioned between the evaporator modular unit 4 and the mechanical modular unit 6. Additionally, or alternatively, a moisture barrier can be positioned on the inside bottom surface of the evaporator module unit housing of the evaporator modular unit 4. Another moisture barrier 54 can also be positioned between the mechanical modular unit 6 and the condenser modular unit 8. A moisture barrier trim 55 can also be positioned around a perimeter of the back side facing grille 16 without blocking the grille. The moisture barriers 54 and moisture barrier trim 55 can be made of any type of moisture resistance material, such as a spray, film, or separate panel of material applied to the surfaces of the evaporator modular unit 4 and/or the mechanical modular unit 6.

Figure 7:
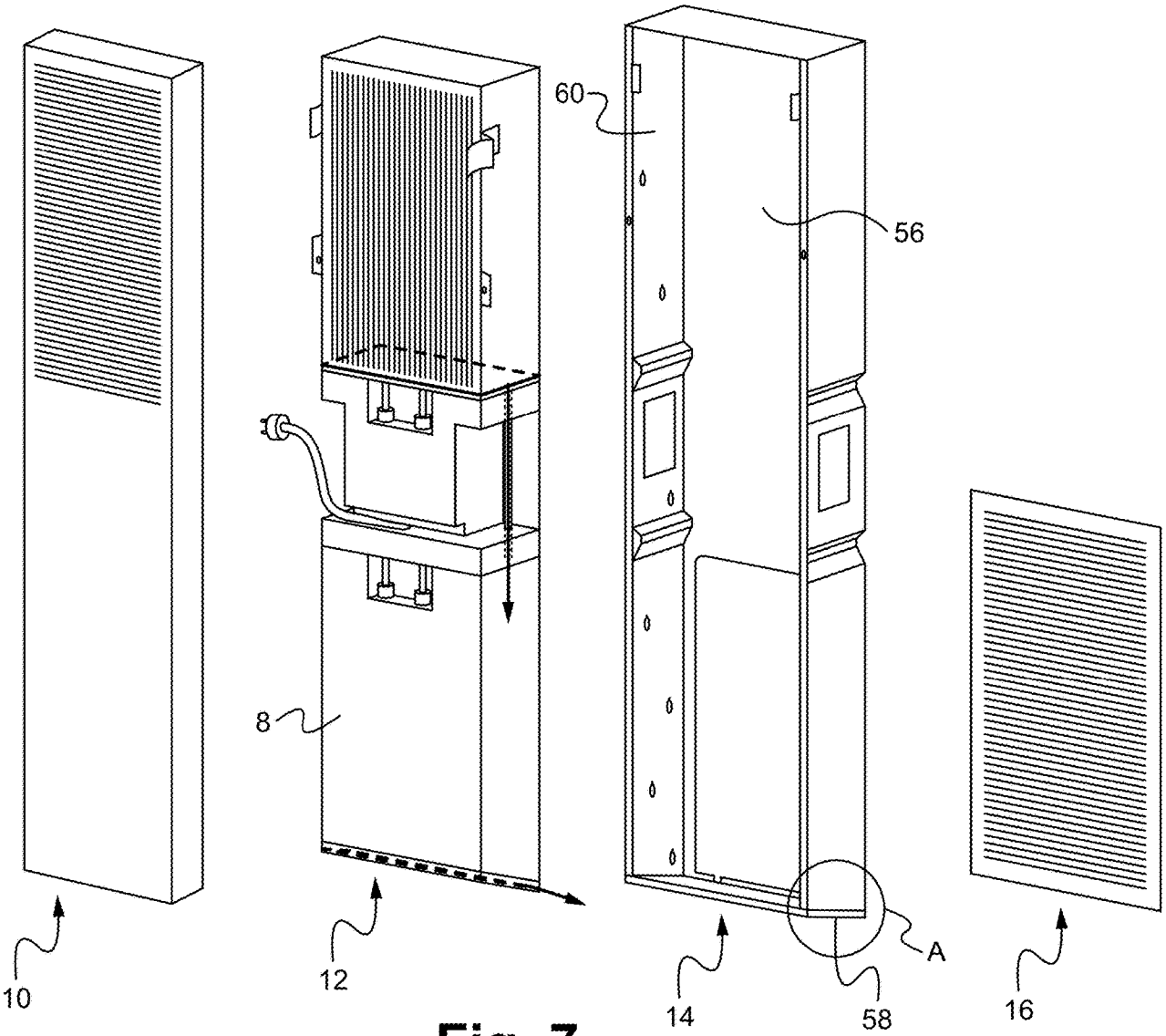
FIG. 7 illustrates an exploded view of the HVAC system including condensate flow according to some embodiments.
Figure 8:
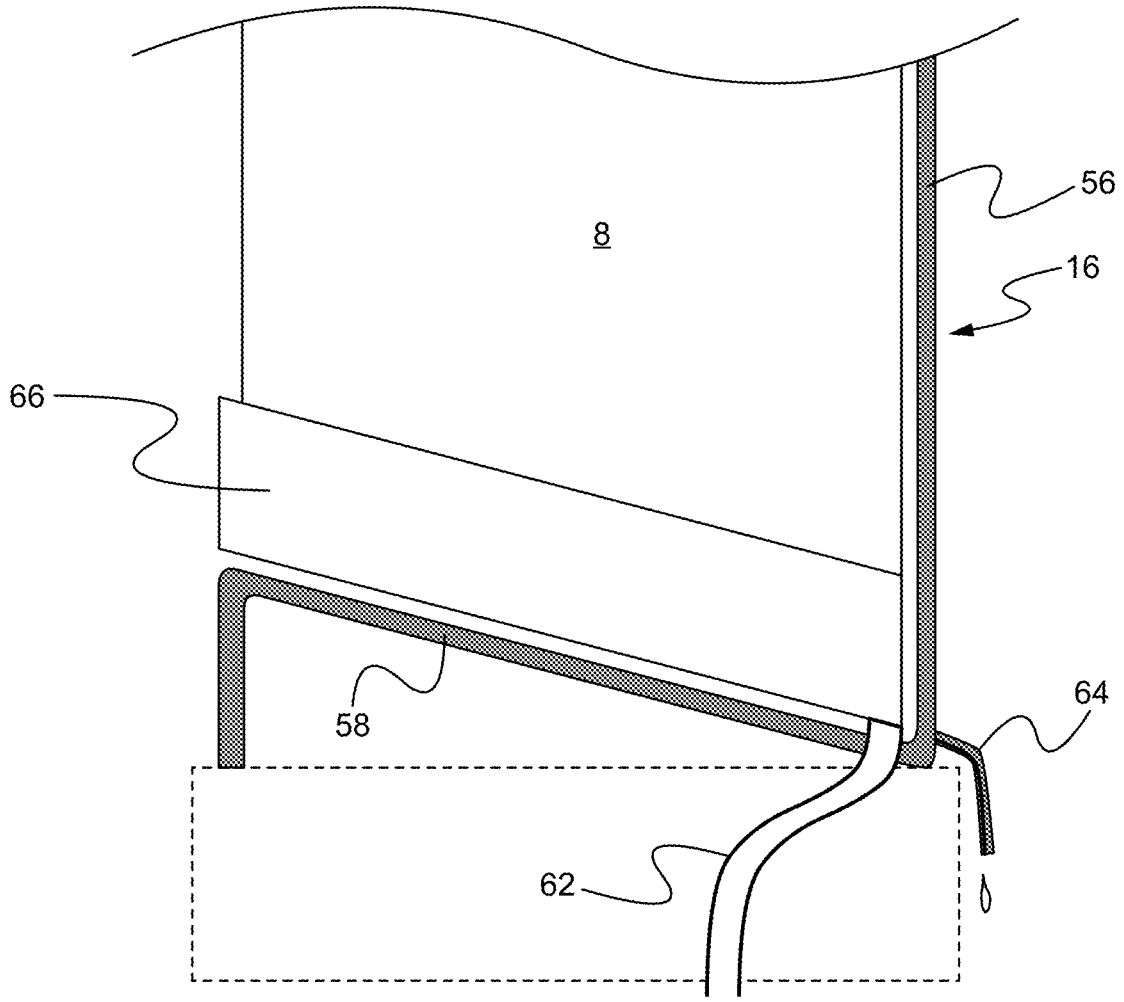
FIG. 8 illustrates a cut out side view of the portion A in FIG. 8 with the HVAC unit mounted in the mounting sleeve according to some embodiments.

Additionally, or alternatively, the HVAC system 2 can be configured to collect and displace condensate. FIG. 7 illustrates an exploded view of the HVAC system 2 including condensate flow according to some embodiments. The evaporator modular unit 4 and the mounting sleeve 14 are configured such that condensate can collect on the interior side surfaces of the mounting sleeve 14 and flow down the interior side surfaces to an interior bottom surface of the mounting sleeve, as shown by the arrows in FIG. 7. In those configurations where the interior back surface of the mounting sleeve 14 does not include thermal or acoustic isolation materials, such as in FIG. 6, condensate can also collect on the interior back surface of the mounting sleeve 14 and flow down the interior back surface to the interior bottom surface of the mounting sleeve. In some embodiments, the bottom surface of the mounting sleeve 14 is sloped, such as shown in FIG. 8, to collect condensate at a bottom most portion. FIG. 8 illustrates a cut out side view of the portion A in FIG. 7 with the HVAC unit 12 mounted in the mounting sleeve 14 according to some embodiments. In this exemplary configuration, a bottom surface (base) of the condenser modular unit 8 is also sloped to match the slope of the mounting sleeve 14. This sloped base enables simple alignment with the mounting sleeve during installation and removes the need to adjust the angle of the HVAC unit 12 for condensate drainage. A drain tube 62 can be attached at the bottom surface of the mounting sleeve 14 to drain out the collected condensate. The drain tube 62 can be directed through a floorboard, such as shown in FIG. 8. Additionally, or alternatively, a drain tube 64 can extend through the back side facing grille 16 to drain out the collected condensate. In some embodiments, a condensate collection tray 66 with one or more drain holes can be positioned at the bottom of the mounting sleeve 14, and the drain tubes 62 and/or 64 can be connected to the condensate collection tray 66.

Condensate within the evaporator modular unit 4 drains to a bottom interior surface of the evaporator module unit housing. One or more drain holes or drain tubes can be positioned at the bottom surface of the evaporator modular unit housing to enable condensate to drain out of the evaporator modular unit 4. In some embodiments, the condensate drains out of the evaporator modular unit 4 and down the interior side surface of the mounting sleeve 14. In some embodiments, condensate output from the evaporator modular unit 4 is directed via drain tubes to the bottom surface of the mounting sleeve 14.

Figure 9:
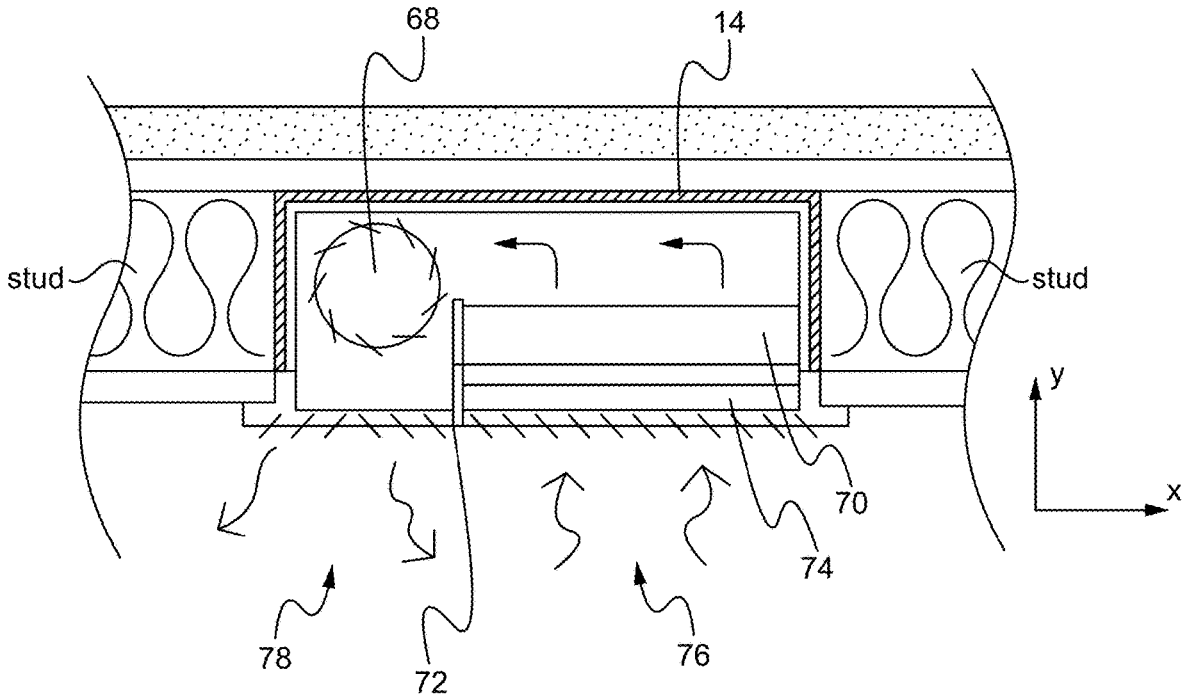
FIG. 9 illustrates a cut-out top down view of an evaporator section installed in a preexisting framework and having a lateral configuration according to some embodiments.

The physical positioning, relative alignment, and dimensions of each of the individual components in each of the evaporator modular unit 4 and the condenser modular unit 8 can vary according to numerous different configurations and applications. In some embodiments, the air mover is positioned to a lateral side of the heat exchanger, i.e. horizontal to the heat exchanger, in either or both of the evaporator modular unit 4 and the condenser modular unit 8. FIG. 9 illustrates a cut-out top down view of an evaporator modular unit installed in a preexisting framework and having a lateral configuration according to some embodiments. The mounting sleeve 14 is mounted to the side walls (studs) and the back wall of the preexisting framework. In the lateral configuration, an air mover 68 is positioned laterally adjacent to a heat exchanger 70. In some embodiments, the air mover 68 includes a tangential fan. It is understood that other types of fans can be used. Input air 76 from the interior of the dwelling is drawn into the evaporator modular unit 4 by the air mover 68 through a first side of a front side grille 72. The input air 76 passes through a filter 74 and across the heat exchanger 70, such as an evaporator coil, and is directed via an air plenum back out the evaporator modular unit 4 through a second side of the front side grille 72 as output air 78. In the exemplary configuration shown in FIG. 9, the first side of the front side grille 72 is the right hand side through which the input air 76 enters, and the second side of the front side grille 72 is the left hand side through which the output air 78 exits. It is understood that these sides can be reversed. The air mover 68, the heat exchanger 70, and the front side grille 72 are analogous to the previously described air mover, heat exchanger, and front side grille of the evaporator modular unit. In some embodiments, turning vanes can be positioned adjacently behind the heat exchanger 70 within the evaporator modular unit 4 to redirect airflow toward the air mover 68, which reduces air pressure drop, and improves or smooths airflow across the heat exchanger. The front side grille 72 can also include curved blades which reduces noise and airflow pressure drop.

Figure 10:
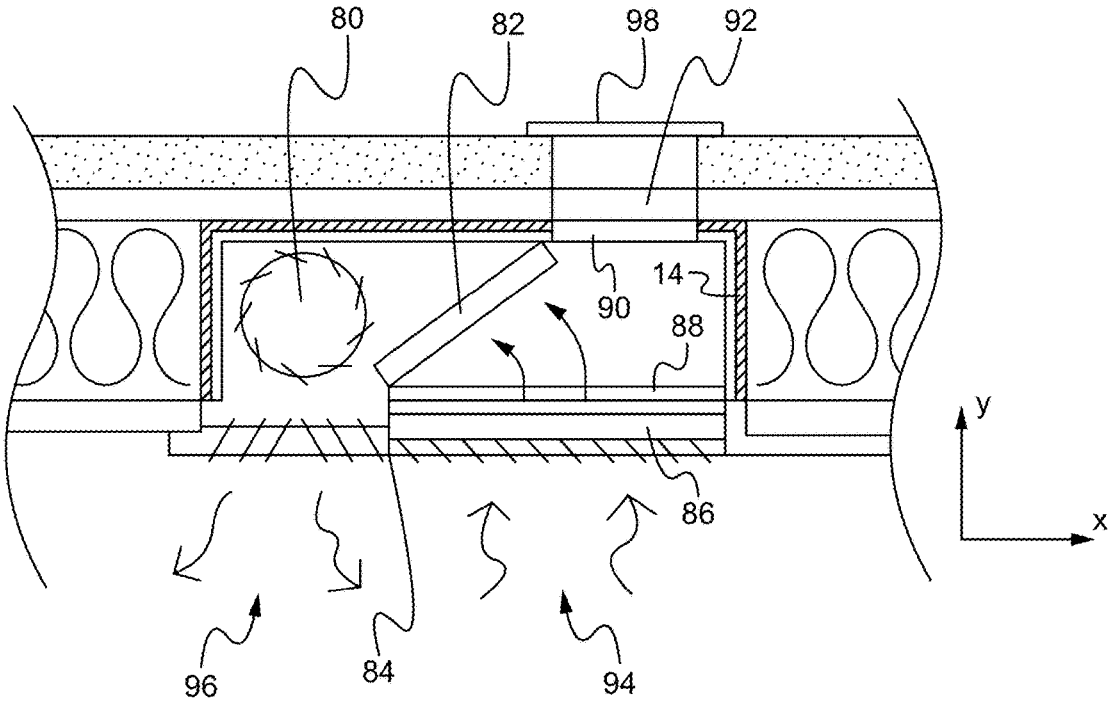
FIG. 10 illustrates a cut-out top down view of an evaporator section installed in a preexisting framework and having a lateral configuration and outdoor ventilation according to some embodiments.

In the above described configurations, the evaporator modular unit has indoor ventilation, via the front side opening in the mounting sleeve and the front side grille, but no outdoor ventilation. In other embodiments, the evaporator modular unit, mounting sleeve, and dwelling wall can be configured to include outdoor ventilation. FIG. 10 illustrates a cut-out top down view of an evaporator modular unit installed in a preexisting framework and having a lateral configuration and outdoor ventilation according to some embodiments. The mounting sleeve 14 is mounted to the side walls (studs) and the back wall of the preexisting framework. In the lateral configuration, an air mover 80 is positioned laterally adjacent to a heat exchanger 82. In some embodiments, the air mover 80 includes a tangential fan. It is understood that other types of fans can be used. Input air 94 from the interior of the dwelling is drawn into the evaporator modular unit 4 by the air mover 80 through a first side of a front side grille 84. The input air 94 passes through an air filter 86 and across the heat exchanger 82, such as an evaporator coil, and is directed via an air plenum back out the evaporator modular unit 4 through a second side of the front side grille 84 as output air 96. In the exemplary configuration shown in FIG. 10, the first side of the front side grille 72 is the right hand side through which the input air 76 enters, and the second side of the front side grille 72 is the left hand side through which the output air 78 exits. It is understood that these sides can be reversed. The air mover 80, the heat exchanger 82, and the front side grille 84 are analogous to the previously described air mover, heat exchanger, and front side grille of the evaporator modular unit. Outdoor ventilation 98 is provided at the back side of the evaporator modular unit 4 via a back side opening in the mounting sleeve 14 and the back wall of the dwelling. The opening is covered on the exterior of the dwelling by a grille (not shown). A balancing damper 92 and an air filter 90 are positioned at the back side opening, and a balancing damper 88 is positioned proximate the air filter 86. The balancing damper 98 can be an automated balancing damper under the control of the HVAC unit controller 34 (FIG. 2). Baffles in the balancing dampers 88, 92 enable mixing of the input air 94 with ambient air from the exterior, which enables control of the air temperature of the air passing across the heat exchanger 82. In some embodiments, the air temperature is controlled to be greater than a threshold temperature. The front side grille 84 can include curved blades which reduces noise and airflow pressure drop. In some embodiments, such as that shown in FIG. 10, the heat exchanger 82 is angled relative to horizontal. The angled orientation increases surface area relative to a horizontally oriented heat exchanger, such as the heat exchanger 70 shown in FIG. 9. It is understood that the angled heat exchanger also can be applied in the lateral configuration shown in FIG. 9, and that the horizontally oriented heat exchanger shown in FIG. 9 can be used in the lateral configuration shown in FIG. 10.

Alternatively to a lateral configuration, a stacked configuration can be used where the air mover is positioned above or below the heat exchanger, i.e. vertical to the heat exchanger, in either or both of the evaporator modular unit 4 and the condenser modular unit 8. An example of such a stacked configuration is described in the co-pending U.S. Patent Application Serial Number entitled "HVAC System with Coil Arrangement in Blower Unit", which is hereby incorporated in its entirety by reference.

Similar lateral or stacked configurations can be used for the condenser modular unit 8, except instead of the input air being input from and output to an interior of the dwelling, air is input from and output to an exterior of the dwelling via a back side grille, such as the back side grille 16. It is understood that such a condenser modular unit can also be configured with interior ventilation to enable mixing of air, such as used in the configuration shown in FIG. 10.

Figure 11:
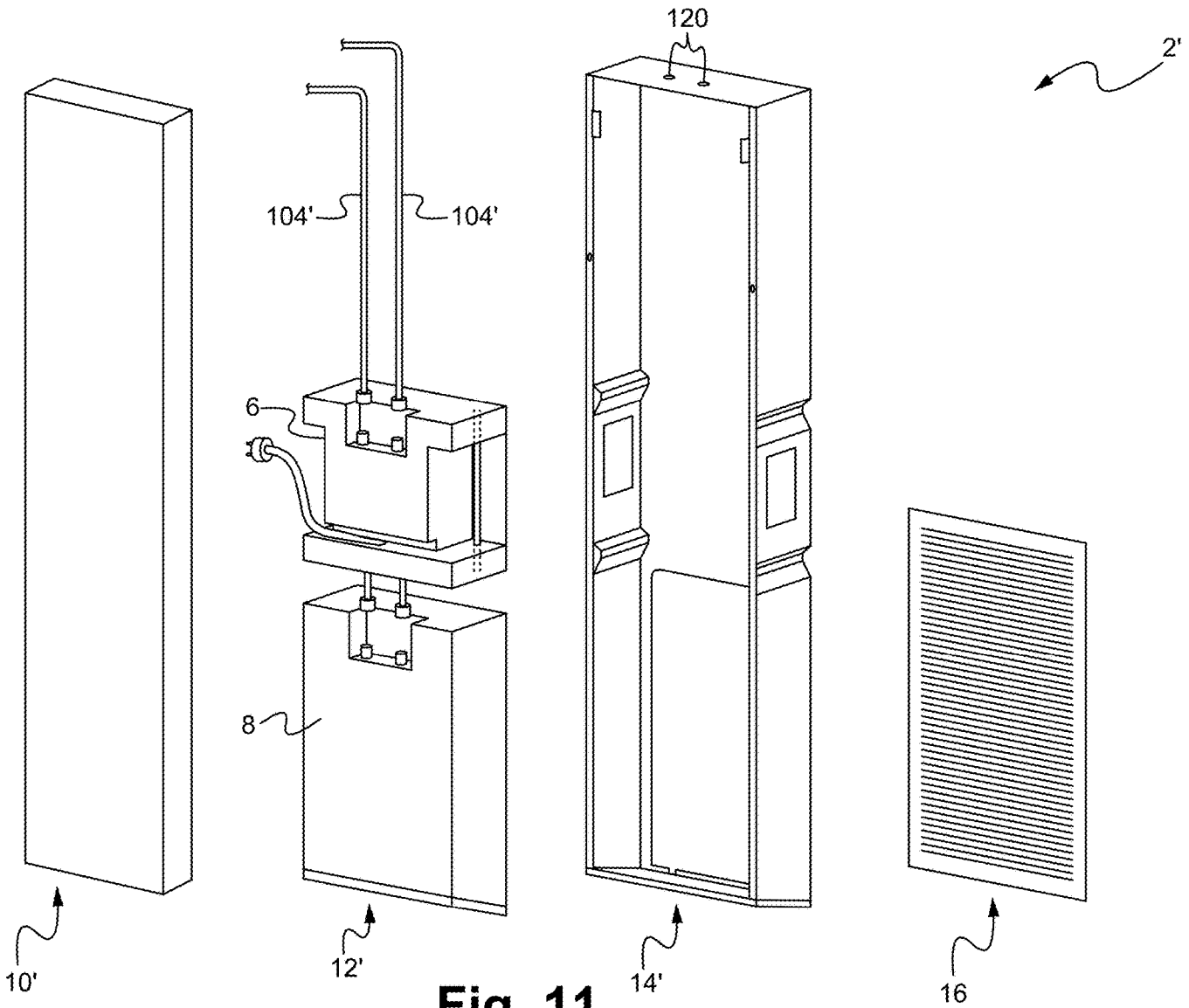
FIG. 11 illustrates an exploded view of an HVAC system modified to have a remotely located evaporator modular unit according to some embodiments.

In the above described configurations, all three of the evaporator modular unit, the mechanical modular unit, and the condenser modular unit are mounted within the mounting sleeve. In an alternative configuration, the mechanical modular unit and the condenser modular unit can be mounted in the mounting sleeve, but the evaporator modular unit is remotely located. FIG. 11 illustrates an exploded view of an HVAC system modified to have a remotely located evaporator modular unit according to some embodiments. The HVAC system 2' of FIG. 11 is similar to the HVAC system 2 except the evaporator modular unit is remotely located from the mounting sleeve 14. In such a configuration, the refrigerant tubing interconnecting the evaporator modular unit to the mechanical modular unit is modified, such as refrigerant tubing 104', to accommodate the greater distance between the two. In an exemplary application, the HVAC system 2' may be installed in a first room of a multi-room dwelling, and another HVAC system 2 may be installed in another room, where the evaporator module unit of the HVAC system 2 is also used by the HVAC system 2'. It is understood that alternative applications are contemplated where a single evaporator module unit, or other type of evaporator device, is used by multiple different HVAC systems, such as the HVAC system 2'.

Figure 12:
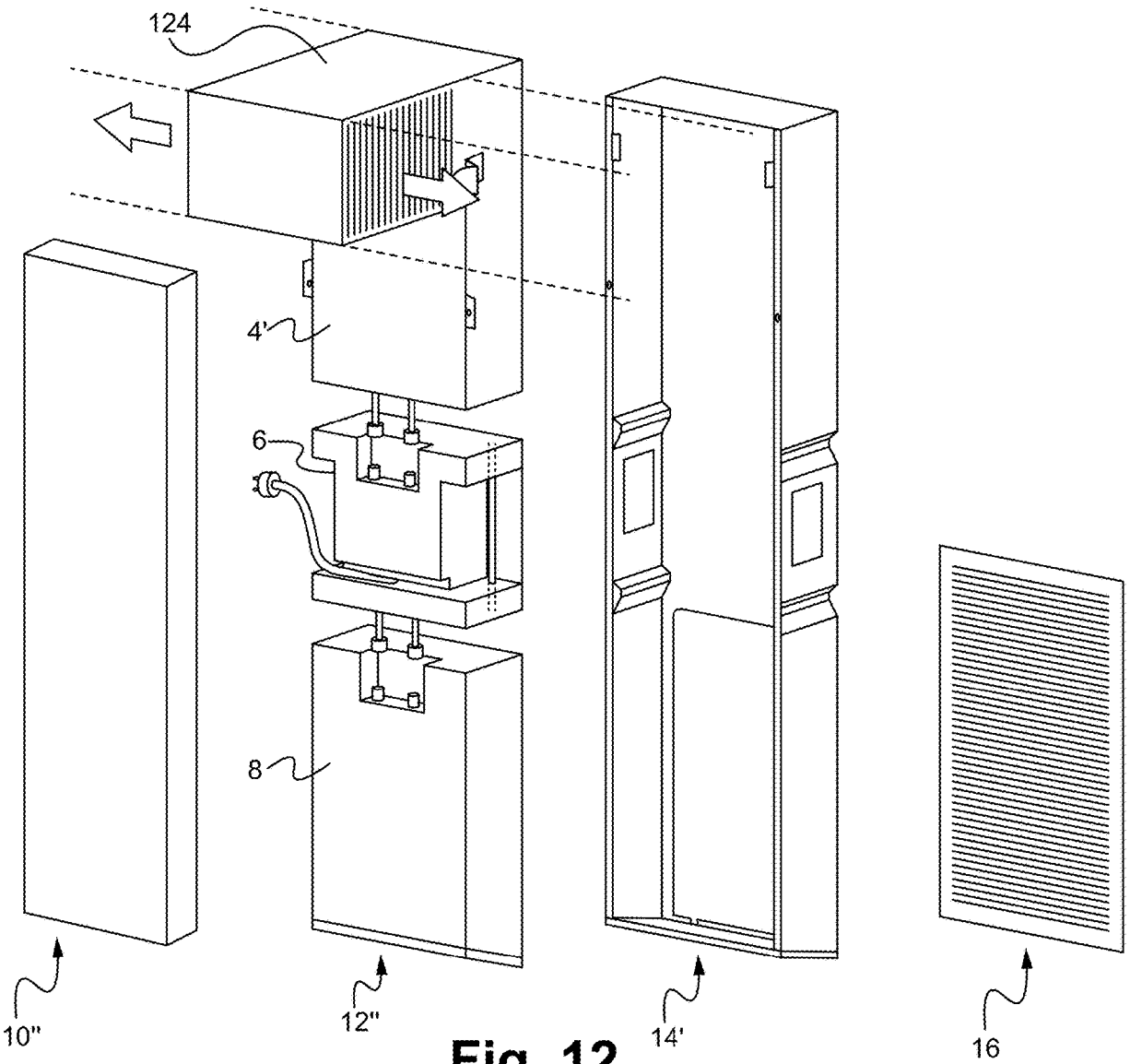
FIG. 12 illustrates an exploded view of an HVAC system modified with an expanded evaporator modular unit according to some embodiments.

In the above described configurations, an entirety of the evaporator modular unit is positioned within the mounting sleeve. In an alternative configuration, a portion of the evaporator modular unit extends outside of the mounting sleeve framework. Such an extension of the evaporator modular unit can be positioned, for example, in a soffit of the dwelling structure. FIG. 12 illustrates an exploded view of an HVAC system modified with an expanded evaporator modular unit according to some embodiments. The HVAC system of FIG. 12 is similar to the HVAC system 2 except the evaporator modular unit is modified, such as evaporator modular unit 4', so that a portion extends away from the mounting sleeve 14. In an exemplary application, the extended portion of the evaporator modular unit 4' extends into a soffit. The grille of the evaporator modular unit 4' is positioned in the extended portion. In some embodiments, a grille can be positioned on either side of the extended portion, one side can be used for airflow input and the other side can be used for airflow output.

The present application has been described in terms of specific embodiments incorporating details to facilitate the understanding of the principles of construction and operation of the HVAC system. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A heating, ventilation, and air condition (HVAC) system comprising:

a. an HVAC unit comprising an evaporator modular unit having a first heat exchanger, a mechanical modular unit having an HVAC unit controller, and a condenser modular unit having a second heat exchanger, wherein the evaporator modular unit, the mechanical modular unit, and the condenser modular unit are separate and distinct modules interconnected by refrigerant tubing; and b. a mounting sleeve configured to fit within a preexisting framework of a dwelling, wherein the evaporator modular unit, the mechanical modular unit, and the condenser modular unit are mounted within the mounting sleeve.

2. The HVAC system of claim 1 further comprising a front side access panel coupled to a front side of the HVAC unit.

3. The HVAC system of claim 2 wherein the front side access panel comprises a front side grille aligned with the evaporator modular unit.

4. The HVAC system of claim 1 further comprising a back side grille coupled to a back side of the HVAC unit.

5. The HVAC system of claim 4 wherein the mounting sleeve includes a back side opening in a back side wall, the back side opening is aligned with the condenser modular unit of the HVAC unit and an exterior opening of the dwelling, further wherein the back side grille is positioned over back side opening.

6. The HVAC system of claim 1 wherein the mounting sleeve comprises a back side wall, side walls, a top wall and a bottom wall, wherein the back side wall is mounted to a framing back side wall of the preexisting framework, and each of the side walls is mounted to a stud of the preexisting framework.

7. The HVAC system of claim 6 wherein one or more of the side walls of the mounting sleeve includes an electrical outlet opening.

8. The HVAC system of claim 7 wherein the mechanical modular unit further comprises an electrical power cord, a first end of which is configured to fit through the electrical outlet opening.

9. The HVAC system of claim 1 wherein the mounting sleeve comprises a bottom side wall that is sloped downward from a front side of the HVAC unit to a back side of the HVAC unit.

10. The HVAC system of claim 9 further comprising a drain tube coupled to the bottom side wall.

11. The HVAC system of claim 9 further comprising a drain tube coupled to the bottom side wall and extending through a back side facing grille coupled to a back side of the HVAC unit.

12. The HVAC system of claim 1 wherein the refrigerant tubing comprises first interconnecting refrigerant tubing coupled to the evaporator modular unit and the mechanical modular unit, and second interconnecting refrigerant tubing coupled to the mechanical modular unit and the condenser modular unit.

13. The HVAC system of claim 1 wherein the HVAC unit further comprises first mounting features and the mounting sleeve further comprises second mounting features for mounting to the first mounting features.

14. The HVAC system of claim 1 wherein the first heat exchanger of the evaporator modular unit comprises an evaporator coil, and the evaporator modular unit further comprises an air mover configured to move air across the evaporator coil.

15. The HVAC system of claim 1 wherein the second heat exchanger of the condenser modular unit comprises a condenser coil, and the condenser modular unit further comprises an air mover configured to move air across the condenser coil.

16. The HVAC system of claim 15 wherein the condenser modular unit further comprises an accumulator coupled to the condenser coil.

17. The HVAC system of claim 1 wherein the mechanical modular unit further comprises a compressor and a metering device.

18. The HVAC system of claim 1 wherein the evaporator modular unit comprises an evaporator modular unit housing, the mechanical modular unit comprises an mechanical modular unit housing, and the condenser modular unit comprises a condenser modular unit housing.

* * * * *